United States Patent [19]

Grous

[11] Patent Number: 4,914,011

[45] Date of Patent: Apr. 3, 1990

[54] PROCESS FOR FORMING ANTI-HALATION LAYERS OF POLYESTER PHOTOGRAPHIC FILM SUPPORTS

[75] Inventor: William R. Grous, Rochester, N.Y.

[73] Assignee: Eastman Kodak Company, Rochester, N.Y.

[21] Appl. No.: 274,157

[22] Filed: Nov. 21, 1988

[51] Int. Cl.[4] ..... G03C 5/24

[52] U.S. Cl. ..... 430/422; 427/40; 427/41; 427/299; 427/322; 430/531; 430/536

[58] Field of Search ..... 427/40, 41, 299, 322; 430/422, 531, 536

[56] References Cited

U.S. PATENT DOCUMENTS 4,039,333 8/1977 Shirogama et al. ..... 430/422

FOREIGN PATENT DOCUMENTS 2108865A 5/1983 United Kingdom ..... 427/41

*Primary Examiner*—Stanley Silverman

*Attorney, Agent, or Firm*—Alfred P. Lorenzo

[57] ABSTRACT

A process for forming an anti-halation layer on the surface of a polyester photographic film support comprises the steps of (1) subjecting the surface to an activation treatment such as, for example, corona discharge treatment; (2) coating the activated surface with a composition comprising an anti-halation agent, such as carbon black, and an alkali-soluble polymeric binder, such as cellulose acetate hexahydrophthlate, dispersed in a liquid organic medium; and (3) drying the coating to thereby form an anti-halation layer which is strongly adherent to the polyester film suport yet is readily removable by an alkaline photographic processing solution.

10 Claims, No Drawings

PROCESS FOR FORMING ANTI-HALATION LAYERS OF POLYESTER PHOTOGRAPHIC FILM SUPPORTS

FIELD OF THE INVENTION

This invention relates in general to photography and in particular to photographic films having a polyester film support. More specifically, this invention relates to polyester film supports provided with an anti-halation layer and to processes whereby such layer is applied to the polyester film.

BACKGROUND OF THE INVENTION

Polyester films, such as films of polyethylene terephthalate, have many advantageous properties, such as excellent strength and dimensional stability, which render them advantageous for use as photographic film supports. In certain applications as photographic film supports, it is necessary that they be provided with an anti-halation layer. The anti-halation layer, which is coated on the side of the support opposite to the image-forming layer(s), functions to prevent light that passes through the film support from being reflected into the image-forming layer(s) and thereby causing an undesired spreading of the image which is known as halation. The anti-halation layer is comprised of an anti-halation agent, typically a dye or pigment which functions to absorb the light, dispersed in an alkali-soluble polymeric binder that renders the layer removable by an alkaline photographic processing solution. In a typical example of a commercially useful anti-halation layer, the light-absorbing material utilized is carbon black and the binder is a cellulose ester such as cellulose acetate hexahydrophthalate.

The photographic art has been faced for many years with a difficult problem in obtaining adequate adhesion of the anti-halation layer to the polyester film. Although the anti-halation layer is removed in processing, it must, of course, be able to remain firmly adhered to the polyester film during normal handling and use prior to such removal. One technique which has met with limited success is to utilize an aqueous film-forming composition containing an anti-halation agent, an acrylate-acrylic acid polymer and ammonium hydroxide. Such compositions and their application to polyester films to form anti-halation layers are described in Thompson et al, U.S. Pat. No. 2,976,168 issued Mar. 21, 1961. Another useful procedure involves application to the polyester film of an aqueous dispersion containing a polymeric binder, an anti-halation agent, and an adhesion promoter. This process is described in Pierce et al, U.S. Pat. No. 3,201,249 issued Aug. 17, 1965. The adhesion promoters are compounds such as resorcinol which funcion as attack agents for the polyester and thereby promote improved adhesion. Use of such an adhesion promoter suffers, however, from serious disadvantages which significantly restrict its commercial utilization. Thus, for example, the amount of resorcinol utilized must be very carefully regulated. If too little is used, the anti-halation layer will tend to come off the polyester support under typical conditions of handling and use. On the other hand, there are also serious disadvantages to the use of too much resorcinol. In particular, resorcinol tends to sublime from the coated layer during drying of the anti-halation layer, and this causes fouling and contamination of the drying equipment and the product. In addition, too much resorcinol promotes such strong adhesion of the anti-halation layer to the polyester support that adequate removal in conventional removal processes cannot be achieved.

It is toward the objective of providing a novel process for the formation of an anti-halation layer on a polyester photographic film support, that avoids the need for use of adhesion promoters such as resorcinol, that the present invention is directed.

SUMMARY OF THE INVENTION

In accordance with this invention, a process for forming an anti-halation layer on the surface of a polyester photographic film support comprises the steps of:

(1) subjecting said surface to an activation treatment, such as, for example, corona discharge treatment;

(2) coating the activated surface with a composition comprising an anti-halation agent and an alkali-soluble polymeric binder dispersed in a liquid organic medium;

and (3) drying the coating to thereby form an anti-halation layer which is strongly adherent to the polyester film support yet is readily removable by an alkaline photographic processing solution.

In a preferred embodiment of the invention, the film support is a polyethylene terephthalate film, the anti-halation agent is carbon black, and the polymeric binder is cellulose acetate hexahydrophthalate.

By the process described herein, the polyester surface is activated so that it is readily wettable by the liquid coating composition and sufficiently subject to attack by the organic medium to provide excellent adhesion which completely avoids the problem of premature removal of the anti-halation layer. At the same time, the process is one which does not require an adhesion promoter and thereby completely avoids the formation of sublimates and resulting generation of unwanted deposits. It is by the combined use of the surface activation treatment and an anti-halation coating composition which is an organic rather than an aqueous medium that the desired combination of excellent adhesion but easy removal in alkaline processing solutions is achieved.

DESCRIPTION OF THE PREFERRED EMBODIMENTS

The polyester film supports which are employed in the process of this invention are well known and widely used materials. Such film supports are typically prepared from high molecular weight polyesters derived by condensing a dihydric alcohol with a dibasic saturated fatty carboxylic acid or derivatives thereof. Suitable dihydric alcohols for use in preparing polyesters are well known in the art and include any glycol wherein the hydroxyl groups are on the terminal carbon atom and contain from 2 to 12 carbon atoms such as, for example, ethylene glycol, propylene glycol, trimethylene glycol, hexamethylene glycol, decamethylene glycol, dodecamethylene glycol, and 1,4-cyclohexane dimethanol. Dibasic acids that can be employed in preparing polyesters are well known in the art and include those dibasic acids containing from 2 to 16 carbon atoms. Specific examples of suitable dibasic acids include adipic acid, sebacic acid, isophthalic acid, and terephthalic acid. The alkyl esters of the above-enumerated acids can also be employed satisfactorily. Other suitable dihydric alcohols and dibasic acids that can be employed in preparing polyesters from which sheeting can be prepared are described in J. W. Wellman, U.S. Pat. No. 2,720,503, issued Oct. 11, 1955.

Specific preferred examples of polyester resins which, in the form of sheeting, can be used in this invention are poly(ethylene terephthalate), poly(cyclohexane 1,4-dimethylene terephthalate), and the polyester derived by reacting 0.83 mol of dimethyl terephthalate, 0.17 mol of dimethyl isophthalate and at least one mol of 1,4-cyclo-hexanedimethanol. U.S. Pat. No. 2,901,466 discloses polyesters prepared from 1,4-cyclohexanedimethanol and their method of preparation.

The thickness of the polyester sheet material employed in carrying out this invention is not critical. For example, polyester sheeting of a thickness of from about 0.05 to about 0.25 millimeters can be employed with satisfactory results.

In a typical process for the manufacture of a polyester photographic film support, the polyester is melt extruded through a slit die, quenched to the amorphous state, oriented by transverse and longitudinal stretching, and heat set under dimensional restraint. In addition to being directionally oriented and heat set, the polyester film can also be subjected to a subsequent heat relax treatment to provide still further improvement in dimensional stability and surface smoothness.

As a first step in the process of this invention, the polyester film is subjected to a surface activation treatment. Many different methods of achieving surface activation are known in the art. Examples of such methods include flame treatment as described in U.S. Pat. No. 3,072,483; corona discharge treatment as described in British Pat. Nos. 971,058 and 1,060,526 and U.S. Pat. Nos. 2,864,755, 3,117,865, 3,220,842, 3,411,910, 3,531,314, 4,298,440 and 4,649,097; and chemical treatment as described in U.S. Pat. Nos. 2,893,896, 3,419,410 and 3,740,252.

Activation of the polyester surface is preferably carried out in accordance with this invention by the action of corona discharge. The corona discharge applied to the polyester surface can be supplied by well-known power sources. The spark-gap-type power source for the corona has current applied to the electrodes by a spark-gap excited oscillator in a well-known manner. Variation in fundamental frequency of the corona is obtained by changing the primary power frequency of the oscillator in a range up to 10,000 or more cycles per second. A high-voltage corona is desirable, e.g., 25,000 to 50,000 peak volts or higher, to obtain adequate adhesion to the corona activated surface. Voltages of this range are adequate for corona activation of polyesters at web speeds of several hundred meters per minute.

The corona can be applied to the polyester surface, for example, by means of several metal electrodes positioned close to the surface at a point where the surface is passing over a grounded metal rol coated with a dielectric. Similarly, a metal roller may be used to support the web with the other electrode array being in planatary disposition equidistant from the surface of the metal roller and each being coated with a dielectric, at least on the surface nearest the metal roller. The spacing of the electrodes to the polyester surface and ground roll should be adequate to produce the corona at the voltage used and yet allow for free passage of the sheet through the activating zone. Corona supplied by AC current, or a combination of AC superimposed on DC can be used.

It is known to apply antistatic coating compositions to polyester films which have been subjected to surface activation. Such a process is described in U.S. Pat. No. 4,301,239. However, the composition which forms the antistatic layer is an aqueous composition, and it contains a cross-linkable polymer and a cross-linking agent, whereby a permanent antistatic layer that survives processing in photographic developers and other processing solutions is achieved. This involves distinctly different requirements than the present process in which a removable anti-halation layer is desired. Thus, in the present invention the anti-halation layer must exhibit both the characteristic of being firmly adherent and the characteristic of being easily removable in processing. This combination of characteristics is extremely difficult to achieve and is in no way involved when the objective is to provide a permanent antistatic layer.

It is also known from U.S. Pat. No. 3,220,842 to manufacture photographic stripping films in which a subbing composition or a photographic emulsion is applied to an electron-bombarded poly(ethylene terephthalate) film. However, such a film does not employ a removable anti-halation layer.

Improvement in the adhesion of various coatings to polyester films by the use of a surface activation treatment is also disclosed in U.S. Pat. Nos. 3,607,354 and 4,594,262 and in an article entitled, "Surface Modification Of Poly(Ethylene Terephthalate) By Electrical Discharge Treatment", Briggs et al, POLYMER, pp. 895–900, August 1980. However, these references are not concerned with anti-halation layers and thus do not involve the difficult problem of combining firm adherence with easy removability that characterizes the use of such layers.

To form the anti-halation layer, a coating composition comprising an anti-halation agent and an alkali-soluble polymeric binder dispersed in a liquid organic medium is coated on the activated surface of the polyester. Any suitable method of coating can be used. Useful coating methods include roll coating, gravure coating, extrusion coating, bead coating, curtain coating, use of wire wound coating rods, and so forth. The wet thickness of the coating is typically in the range from about 0.01 to about 0.05 millimeters, and more preferably from about 0.02 to about 0.03 millimeters.

Useful anti-halation agents are described in U.S. Pat. No. 3,201,249 and include pigments, dyes and mixtures thereof. Examples of suitable dyes or pigments include hydroxyazaindolizines, xanthylium salts, pyrylium salts, triphenylmethane derivatives, methine and polymethine dyes, Prussian blue, titanium dioxide, manganese dioxide, and carbon black.

Useful alkali-soluble polymeric binders are described in U.S. Pat. No. 3,201,249. Examples of suitable binders include copolymers of alkyl methacrylates and methacrylic acid, carboxy ester lactone resins, polyvinyl phthalates, polyvinyl acetate phthalates, ethyl cellulose phthalates and cellulose organic acid esters containing dicarboxylic acid groups such as cellulose acetate phthalate, cellulose acetate maleate, cellulose acetate succinate, cellulose acetate propionate phthalate, cellulose acetate propionate maleate, and cellulose acetate propionate succinate.

To form the anti-halation coating composition, the anti-halation agent and the alkali-soluble polymeric binder are dispersed in a liquid organic medium. The composition of such medium can vary widely as desired. Useful organic liquids include alcohols such as methanol, ethanol, n-propyl alcohol, isopropyl alcohol, n-butyl alcohol, isobutyl alcohol, n-pentyl alcohol, n-hexyl alcohol, and the like, organic esters such as methyl acetate, ethyl acetate, n-propyl acetate, isobutyl acetate, ethyl propionate, ethyl isobutyrate, and the like; ketones such as acetone, methyl ethyl ketone, methyl n-propyl ketone, diethyl ketone, and the like; ethers such as diethyl ether, methyl ethyl ether, diisopropyl ether, and the like; glycols such as ethylene glycol, propylene glycol, butylene glycol, and the like, glycol-ethers such as 2-methoxyethanol, 1-methoxy-2-propanol, and the like; hydrocarbons such as pentane, hexane and the like; and halogenated hydrocarbons such as methylene chloride, 1,2-dichloroethane, and the like.

The term "liquid organic medium", as used herein, refers to any liquid medium which is composed in major part by weight of one or more organic liquids. Thus, the liquid organic medium can, if desired, be entirely organic or it can be a mixed aqueous/organic system composed of a major part by weight of organic liquid and a minor part by weight of water. When carbon black is used as the anti-halation agent, it is desirable to include water in the system to aid in its dispersion. Surfactants are also advantageously employed for this purpose, with particularly good results being provided by the alkali metal salts of polymeric carboxylic acids or of condensed naphthalene sulfonic acid available from Rohm and Haas Corporation under the trademark TAMOL.

It is particularly preferred in the process of this invention, to use a mixture of a low boiling organic liquid having a boiling point at atmospheric pressure of 65° C. or less, a high boiling organic liquid having a boiling point at atmospheric pressure of 100° C. or more, and an intermediate boiling organic liquid having a boiling point at atmospheric pressure of greater than 65° C. and less than 100° C. Such a mixture of low boiling, intermediate boiling and high boiling organic liquids is especially advantageous since it effectively solubilizes the polymeric binder, such as cellulose acetate hexahydrophthalate, and also provides a suitable drying rate which is neither too rapid, so as to cause poor physical and/or electrical properties in the coating, nor too slow, so as to make economical operation on a commercial scale impractical.

A particularly preferred mixture of organic liquids for use with cellulose acetate hexahydrophthalate is a mixture utilizing acetone as the low boiling organic liquid, ethanol as the intermediate boiling organic liquid, and 1-methoxy-2-propanol as the high boiling organic liquid.

When cellulose acetate hexahydrophthalate is used as the alkali-soluble polymeric binder and carbon black is used as the anti-halation agent, it is especially preferred that the liquid organic medium be composed of about 12 to 20 percent by weight water, about 8 to 15 percent by weight acetone, about 50 to 70 percent by weight ethanol and about 10 to 15 percent by weight 1-methoxy-2-propanol.

The useful amounts of anti-halation agent, alkali-soluble polymeric binder and liquid organic medium utilized in forming the anti-halation coating compositon are not narrowly critical. Typical amounts are from about 85 to 98 percent by weight of liquid organic medium, from about 1 to about 5 percent by weight of anti-halation agent, and from about 1 to about 10 percent by weight of alkali-soluble polymeric binder.

After it is coated, the anti-halation layer is dried by contact with warm dry air or other gaseous drying medium. Suitable drying conditions are a temperature in the range of from about 80° to about 140° C. and a time of from about 0.1 to about 0.5 minutes.

To form a photographic element, one or more image-forming layers are coated on the support on the side opposite to the anti-halation layer. Other layers, such as subbing layers, interlayers, filter layers, protective overcoat layers and so forth can also be present. The image-forming layer or layers of the element typically comprise a radiation-sensitive agent, e.g., silver halide, dispersed in a hydrophilic water-permeable colloid. Suitable hydrophilic vehicles include both naturally occurring substances such as gelatin and synthetic polymer substances such as acrylamide polymers or poly(vinylpyrrolidone).

The invention is further illustrated by the following example of its practice.

A photographic film base composed of biaxially oriented heat-set and heat-relaxed poly(ethylene terephthalate) with a thickness of 0.12 millimeters was surface activated by corona discharge treatment. The film was conveyed through the corona discharge apparatus at a speed of 66 meters per minute under conditions providing an energy input of 5376 joules/$m^2$. Immediately, after the corona discharge treatment, the film was coated by means of an extrusion hopper with an anti-halation layer formed from the coating formulation hereinafter described. The wet thickness of the coated layer was 0.027 millimeters and the coating was dried by the use of forced hot air at a temperature of 129° C.

The coating composition employed to form the anti-halation layer was as follows:

| Component | Weight % |
|---|---|
| Carbon black | 1.25 |
| Cellulose acetate hexahydrophthalate | 2.50 |
| TAMOL SN (sodium salt of condensed naphthalene sulfonic acid) | 0.05 |
| 1-Methoxy-2-propanol | 11.12 |
| Ethanol | 59.10 |
| Acetone | 10.57 |
| Water | 15.41 |
| | 100.00 |

The anti-halation layer was found to be strongly adherent to the surface-activated poly(ethylene terephthalate) film yet readily removable by an alkaline photographic processing solution. To determine adhesion, a piece of tape coated with pressure-sensitive adhesive was applied to the anti-halation coating and then stripped off. To determine removability, the film support was immersed in an alkaline solution for 10 seconds and then rinsed with water. The film support prepared in accordance with this invention exhibited excellent adhesion, in that none of the anti-halation layer was removed by stripping of the tape, and also exhibited easy removability in that the anti-halation layer was cleanly removed by the immersion in alkaline solution and water rinsing. In marked contrast, an otherwise identical film support prepared by a process such as that of U.S. Pat. No. 3,201,249, in which resorcinol is employed as an adhesion promoter, exhibited inferior adhesion, since stripping of the tape removed most of the anti-halation layer, and also exhibited inferior removability as demonstrated by the fact that a scum-like coating remained on the film after the treatment in alkaline solution and water rinsing.

The invention has been described in detail with particular reference to certain preferred embodiments thereof, but it will be understood that variations and modifications can be effected within the spirit and scope of the invention.

What is claimed is:

1. A process for forming an anti-halation layer on the surface of a polyester photographic film support, said process comprising the steps of:

(1) subjecting said surface to an activation treatment;

(2) coating said activated surface with a compositon comprising an anti-halation agent and an alkali-soluble polymeric binder dispersed in a liquid organic medium; and (3) drying said coating to thereby form an anti-halation layer which is strongly adherent to said polyester film support yet is readily removable by an alkaline photographic processing solution.

2. The process of claim 1 wherein said film support is a polyethylene terephthalate film.

3. The process of claim 1 wherein said surface activation treatment is a corona discharge treatment.

4. The process of claim 1 wherein said anti-halation agent is carbon black.

5. The process of claim 1 wherein said polymeric binder is cellulose acetate hexahydrophthalate.

6. The process of claim 1 wherein said liquid organic medium is composed in minor part of water and in major part of a mixture of at least one low boiling organic liquid having a boiling point at atmospheric pressure of 65° C. or less, at least one high boiling organic liquid having a boiling point at atmospheric pressure of 100° C. or more, and at least one intermediate boiling organic liquid having a boiling point at atmospheric pressure of greater than 65° C. and less than 100° C.

7. The process of claim 1 wherein said liquid organic medium is composed in minor part of water and in major part of a mixture of acetone, ethanol and 1-methoxy-2-propanol.

8. The process of claim 1 wherein said polymeric binder is cellulose acetate hexahydrophthalate, said anti-halation agent is carbon black, and said liquid organic medium is composed of about 12 to 20 percent by weight water, about 8 to 15 percent by weight acetone, about 50 to 70 percent by weight ethanol and about 10 to 15 percent by weight 1-methoxy-2-propanol.

9. A polyester photographic film support having an anti-halation layer formed by the process of claim 1.

10. A photographic film comprising a polyester film support, at least one image-forming layer on one side of said support, and on the opposite side of said support, an anti-halation layer formed by the process of claim 1.

* * * * *